US008680989B2

(12) United States Patent
George

(10) Patent No.: US 8,680,989 B2
(45) Date of Patent: Mar. 25, 2014

(54) SENSOR TO DETECT AN EMERGENCY EVENT

(75) Inventor: Moses George, Sunnyvale, CA (US)

(73) Assignee: QUALCOMM Incorporated, San Diego, CA (US)

( * ) Notice: Subject to any disclaimer, the term of this patent is extended or adjusted under 35 U.S.C. 154(b) by 464 days.

(21) Appl. No.: 12/974,682

(22) Filed: Dec. 21, 2010

(65) Prior Publication Data

US 2012/0154157 A1 Jun. 21, 2012

(51) Int. Cl.
*G08B 1/08* (2006.01)

(52) U.S. Cl.
USPC ..... 340/539.22; 340/584; 340/539.26

(58) Field of Classification Search
USPC ..... 340/539.22, 539.26, 584
See application file for complete search history.

(56) References Cited

U.S. PATENT DOCUMENTS 5,470,233 A * 11/1995 Fruchterman et al. ..... 434/112
6,992,580 B2 * 1/2006 Kotzin et al. ..... 340/539.11
7,336,166 B2 * 2/2008 Akamatsu ..... 340/506
7,466,235 B1 * 12/2008 Kolb et al. ..... 340/573.1
7,498,936 B2 * 3/2009 Maeng ..... 340/539.1
8,085,145 B2 * 12/2011 Fu et al. ..... 340/539.22
2005/0195079 A1 * 9/2005 Cohen ..... 340/539.12
2006/0226973 A1 * 10/2006 Catlin ..... 340/539.11
2008/0014901 A1 * 1/2008 Motley et al. ..... 455/404.1
2008/0169921 A1 * 7/2008 Peeters ..... 340/539.11
2008/0177969 A1 * 7/2008 Miriyala et al. ..... 711/170
2009/0085873 A1 * 4/2009 Betts et al. ..... 345/169

OTHER PUBLICATIONS

CR4, <http://cr4.globalspec.com/thread/60328/Smart-Phone-Emergency-SOS-Application>; Sep. 23, 2010.
My911, Inc., <http://www.my-911.com/My911_Services.html#My911_Automatic_Accident_Response> (retrieved Mar. 17, 2011).

* cited by examiner

*Primary Examiner* — Kerri McNally
(74) *Attorney, Agent, or Firm* — Mahamedi Paradice Kreisman LLP

(57) ABSTRACT

A device including a sensor to detect information around the device, an audio component to output an audible alert if an emergency event is detected, a display device to render emergency data from the device, and a controller to use the information to identify an emergency event of a user and select the emergency data from the device based on the emergency event, wherein the emergency data is associated with the user.

18 Claims, 7 Drawing Sheets

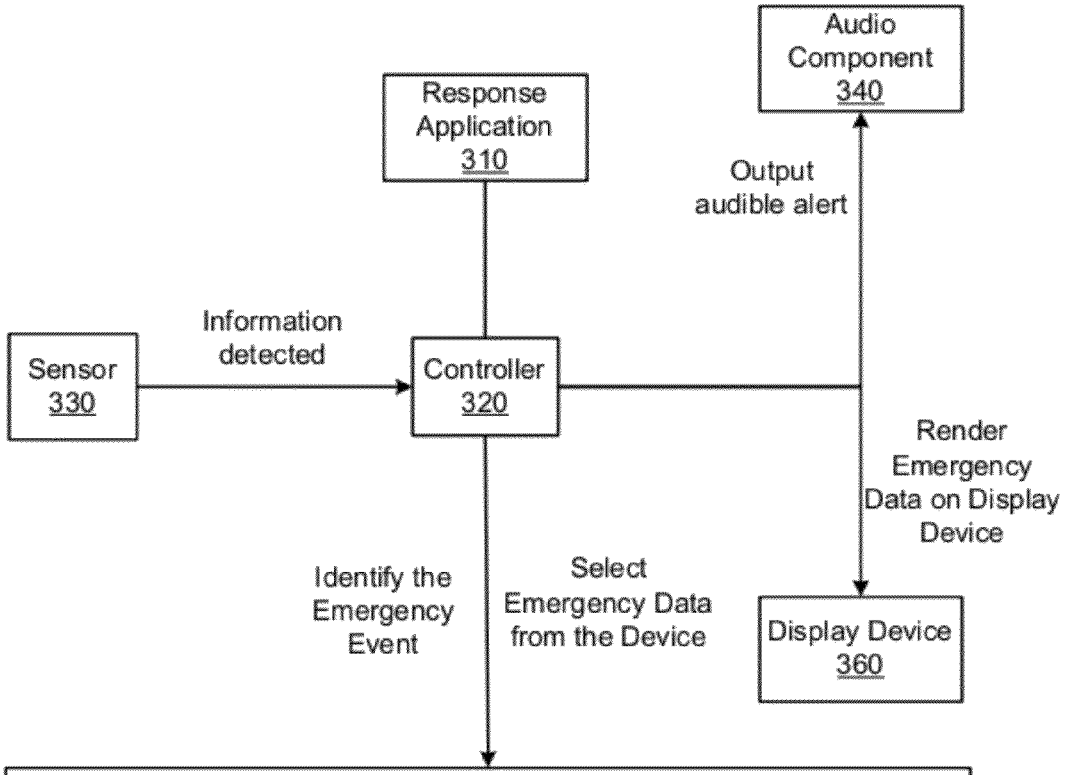

| Database 395 | | |
|---|---|---|
| Predefined Condition | Emergency Event | Emergency Data Associated with User |
| Device moving above predefined speed and sudden stop or recoil detected | Accident involving an Impact | Display User Profile<br>Message: "Call 911"<br>Message: "Call spouse"<br>Message: "Call Family Doctor" |
| Voice recognition detects audible cry/scream/shout/ call for help | Emergency Alert (User in Danger) | Display User Profile<br>Display: Most recent contacts<br>Message: "Call 911"<br>Message: "Call spouse" |
| Temperature around the device/user above threshold temperature | Fire | Display User Profile<br>Display: Most recent contacts<br>Message: "Call 911"<br>Message: "Call spouse" |
| Location of user outside predefined locations | User Lost | Display User Profile<br>Display: Most recent contacts<br>Message: "Call 911"<br>Message: "Call spouse" |
| Components of device not responding to Polling/ Request | Accident | Message: "User may be in Danger"<br>Display: Most recent contacts<br>Message: "Call spouse" |

*Figure 3*

SENSOR TO DETECT AN EMERGENCY EVENT

BACKGROUND

If a user is in an emergency situation, the user can attempt to access a communication device around the user and attempt to contact an emergency response service with the communication device. Once the user has been connected to the emergency response service, the user can proceed to provide details of the emergency situation and any additional information of the user. If the user needs immediate assistance, the user can also attempt to alert another person around the user and solicit assistance from the person.

BRIEF DESCRIPTION OF THE DRAWINGS

Various features and advantages of the disclosed embodiments will be apparent from the detailed description which follows, taken in conjunction with the accompanying drawings, which together illustrate, by way of example, features of the disclosed embodiments.

FIG. 3 illustrates a block diagram of a response application identifying and responding to an emergency event according to an embodiment.

DETAILED DESCRIPTION

A sensor of a device can be used to detect information around the device and a controller of the device can presume that a user is using the device and is within proximity of the device. The controller can use the detected information to identify an emergency event of a user. In response to detecting the emergency event, an audio component can output an audible alert. As a result, one or more people around the user can automatically be alerted and/or notified if the user needs immediate assistance. Additionally, the controller can select emergency data from the device which is based on the emergency event and is associated with the user. The controller can then render the selected emergency data on a display device. By rendering emergency data associated with the user, a person alerted of the user's emergency event can be provided with emergency data which may be used to assist the user.

Figure 1:
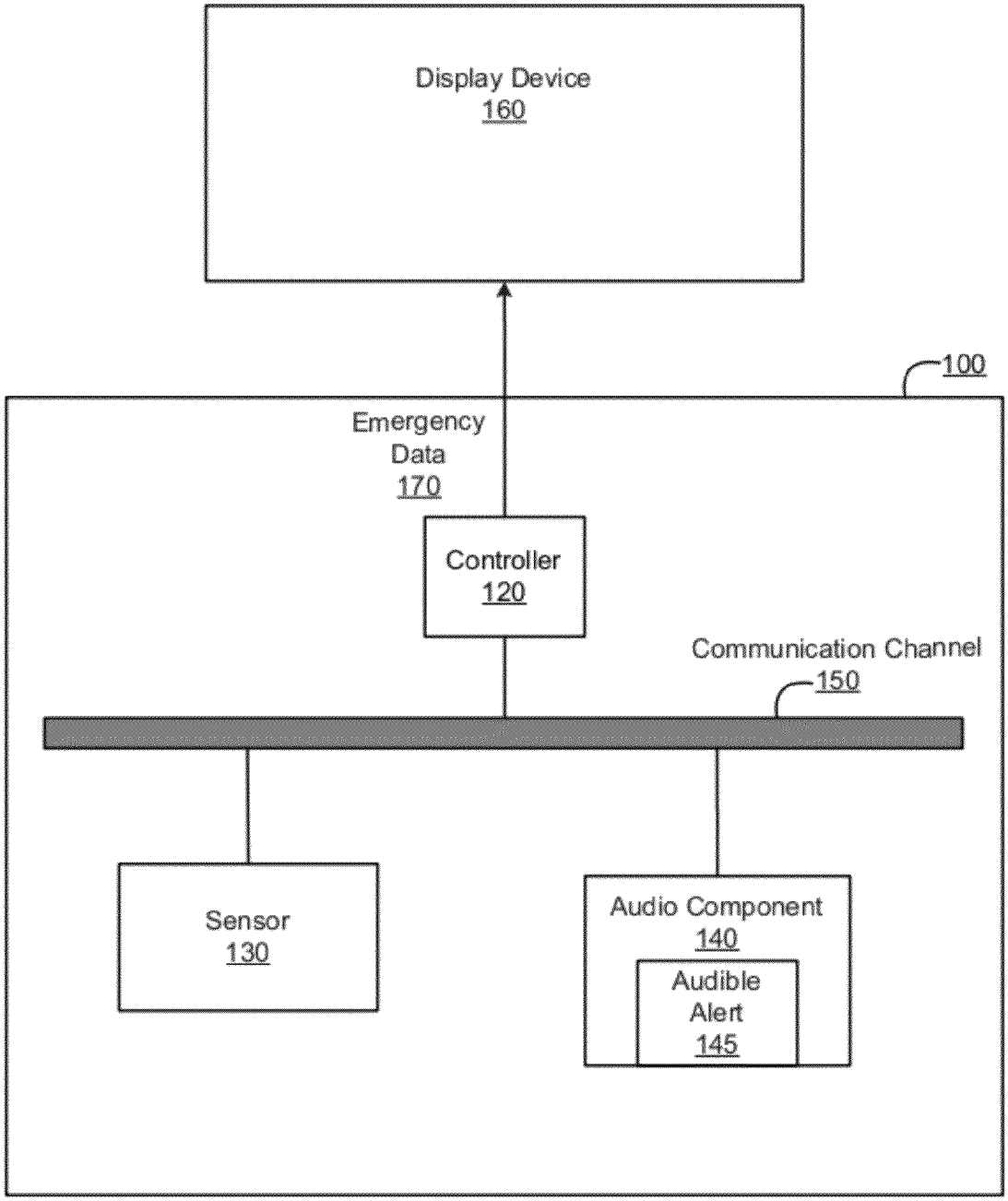
FIG. 1 illustrates a device with a controller, a sensor, an audio component, and a display device according to an embodiment.

FIG. 1 illustrates a device 100 with a controller 120, a sensor 130, an audio component 140, and a display 160 device according to an embodiment. In one embodiment, the device 100 is or includes a cellular device, a PDA (Personal Digital Assistant), an E (Electronic) Book/Reader and/or the like. In another embodiment, the device 100 is a desktop, a laptop, a notebook, a tablet, a netbook, an all-in-one system, a server, and/or any additional device which can include a sensor 130, an audio component 140, and a display device 160.

As illustrated in FIG. 1, the device 100 includes a controller 120, a sensor 130, an audio component 140, a display device 160, and a communication channel 150 for the device 100 and/or one or more components of the device 100 to communicate with one another. In one embodiment, the device 100 additionally includes a response application stored on a storage device coupled to the device 100. In other embodiments, the device 100 includes additional components and/or is coupled to additional components in addition to and/or in lieu of those noted above and illustrated in FIG. 1.

As noted above, the device 100 includes a controller 120. The controller 120 can send data and/or instructions to the components of the device 100, such as the sensor 130, the audio component 140, the display device 160, and/or the response application. The controller 120 can also receive data and/or instructions from components of the device 100, such as the sensor 130, the audio component 140, the display device 160, and/or the response application.

The response application is an application which can be utilized in conjunction with the controller 120 to respond to an emergency event of a user. For the purposes of this application, the user can be any person which can use and/or access the device 100. Additionally, the user can be presumed to be within proximity of the device 100.

An emergency event corresponds to an event or circumstance which the user may need emergency assistance from. In one embodiment, the emergency event can include the user being in accident involving an impact, a fire, the user being lost, and/or any additional accident. In another embodiment, the emergency event can include the user making an emergency alert. In other embodiments, the emergency event can include additional events or circumstances which the user may need emergency assistance from in addition to and/or in lieu of those noted above.

When detecting an emergency event, a sensor 130 of the device 100 can detect data and/or information around the device 100 and/or the user. The sensor 130 can detect a speed which the device 100 is moving, a sudden stop or recoil of the device 100, an emergency alert of the user, a temperature around the device 100 exceeding a threshold temperature, and/or a location of the user. In other embodiments, when detecting an emergency event, the sensor 130 can detect additional details in addition to and/or in lieu of those noted above.

Using the detected information, the response application and/or the controller 120 can identify the emergency event. In response to identifying the emergency event, the controller 120 and/or the response application can determine that an emergency event has been detected and one or more audible alerts 145 can be outputted using an audio component 140 of the device 100. The audio component 140 can be an audio device configured to output an audible alert 145. An audible alert 145 can include an audio signal, tone, and/or voice which can be audible to the user and/or to people around the device 100.

The controller 120 and/or the response application can additionally select emergency data 170 from the device 100 based on the emergency event. The emergency data 170 can be associated with the user. In another embodiment, the emergency data 170 can include a profile of the user, specify contact information for one or more people or service providers associated with the user, and list the emergency event. In response to selecting emergency data 170 from the device 100, the controller 120 and/or the response application can proceed to render the emergency data 170 on a display device 160. The display device 160 is an output component coupled to the device 100 and configured to display the emergency data 170 as one or more text, images and/or videos.

The response application can be firmware which is embedded onto the controller 120, the device 100, and/or the storage device of the device 100. In another embodiment, the response application is an application stored on the device 100 within ROM or on the storage device accessible by the device 100. In other embodiments, the response application is stored on a computer readable medium readable and accessible by the device 100 or the storage device from a different location.

Additionally, in one embodiment, the storage device is included in the device 100. In other embodiments, the storage device is not included in the device 100, but is accessible to the device 100 utilizing a network interface included in the device 100. The network interface can be a wired or wireless network interface card. In other embodiments, the storage device can be configured to couple to one or more ports or interfaces on the device 100 wirelessly or through a wired connection.

In a further embodiment, the response application is stored and/or accessed through a server coupled through a local area network or a wide area network. The response application communicates with devices and/or components coupled to the device 100 physically or wirelessly through a communication bus 150 included in or attached to the device 100. In one embodiment the communication bus 150 is a memory bus. In other embodiments, the communication bus 150 is a data bus.

Figure 2:
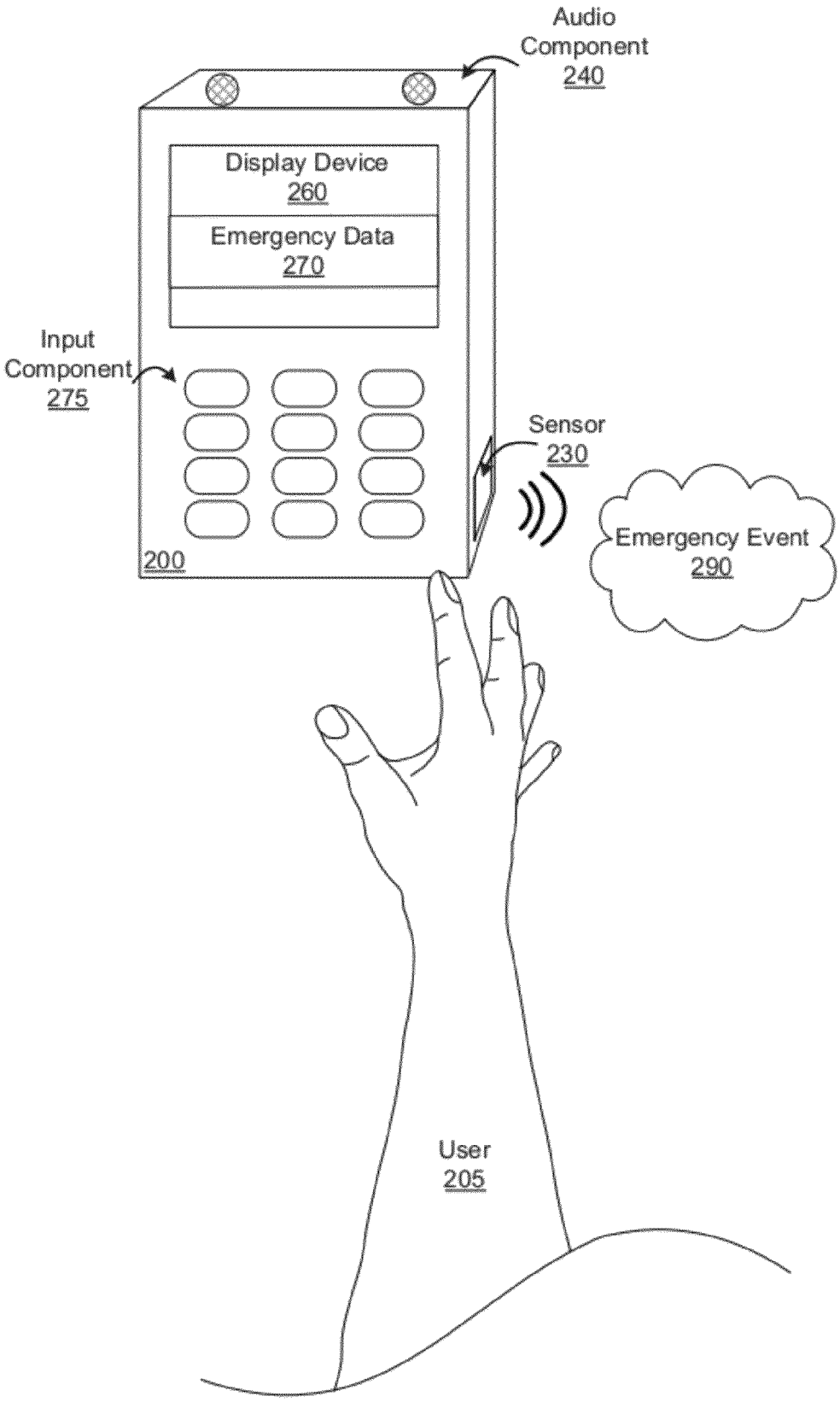
FIG. 2 illustrates a sensor of a device detecting information according to an embodiment.

FIG. 2 illustrates one or more sensors 230 of a device 200 detecting information according to an embodiment. A sensor 230 is a hardware component of the device 200 configured to detect information from around the device 200 for a controller and/or a response application to utilize to identify an emergency event 290 of a user. As illustrated in FIG. 2, one or more of the sensors 230 can be included in the device 200 and/or can be coupled to one or more locations on a surface of the device 200.

In one embodiment, one or more of the sensors 230 can include an accelerometer, a microphone, a thermal sensor, a gyroscope, and/or any additional sensor 230 configured to detect information from the device 200 or around the device 200. One or more of the sensors 230 can actively or continuously detect the information. In another embodiment, one or more of the sensors 230 can periodically and/or upon request from a controller and/or a response application detect the information.

In one embodiment, the information detected can include whether the device 200 is moving and what speed or velocity the device 200 is moving at. Additionally, the information detected can include whether the device 200 has abruptly stopped and/or recoiled if in motion. In another embodiment, the information detected can include a temperature around the device 200. The temperature can be an ambient temperature used to identify an environmental condition around the device 200 and/or the user 205. In another embodiment, the information detected can include a location of device 200.

In other embodiments, the information detected can include one or more emergency alerts from the user 205. An emergency alert can include one or more audible noises and/or signals from the user 205. In one embodiment, the emergency alert can be a yell, a shout, a cry and/or a scream from the user. The emergency alert can be the user calling for "help" or "assistance."

In other embodiments, the detected information can be whether one or more components of the device 200 respond to a poll by the sensor 230, the controller, and/or the response application. Because the user may need emergency assistance from different or unique scenarios and one or more components may become damaged or unresponsive from the scenarios, the sensor 230, the controller, and/or the response application can poll one or more components of the device 200 to ensure that they are still functional.

In response to the sensor 230 detecting any information from the device 200 or around the device 200, the controller and/or the response application can compare the detected information to one or more predefined conditions and attempt to identify an emergency event 290. In response to identifying the emergency 290, the controller and/or the response application can determine that an emergency event 290 is detected.

If an emergency event 290 has been detected, an audio component 240 of the device 200 can proceed to output one or more audible alerts. In one embodiment, the audio component 240 can include one or more audio speakers which can be coupled to a surface of the device 200. As noted above, one or more audible alerts include a tone, a signal, and/or one or more voices which can be outputted through the audio component 240. In one embodiment, the audio component 240 can be configured to increase a strength and/or frequency of the audio alert over a period of time. By outputting the audio alert, one or more people around the device 200 can be notified that the user 205 may need emergency assistance from the emergency event 290.

As the audio component 240 is outputting one or more audible signals, a display device 260 of the device 200 can render emergency data 270 from the device 200 based on the detected and/or identified emergency event 290. When rendering emergency data 270 on the display device 260, the display device 260 can brighten and display the emergency data 270. In another embodiment, the display device 260 can be configured to display one or more visual alerts which can be flashed or blinked on the display device 260. As noted above, the display device 260 is a component coupled to the device 200 and configured to render one or more text, images, and/or videos. In one embodiment, the display device 260 can be a LCD (liquid crystal display), a LED (light emitting diode) display, a CRT (cathode ray tube) display, a plasma display, a projector and/or any additional device configured to render emergency data 270.

As noted above, one or more emergency data 270 can be stored on the device 200 and can be associated with the user 205. In another embodiment, one or more of the emergency data 270 can be stored on additional locations accessible to the device 200, the controller, and/or the response application. One or more of the emergency data 270 can list the detected and/or identified emergency event 290. In another embodiment, the emergency data 270 can list a profile of the user 205 and/or one or more messages. The profile can list a name of the user 205, an address of the user 205, a phone number of the user 205, and/or any medical condition of the user 205.

In other embodiments, the emergency data 270 can list one or more contacts stored on the device 200. One or more of the contacts can be predefined by the user and correspond to a person to contact if the user 205 has been in an emergency event 290. In one embodiment, one or more of the contacts can include a recent contact on the device 200. A recent contact can be any person which the user 205 recently was in contact with. In another embodiment, one or more of the contacts can be an emergency service provider or any additional service provider. In other embodiment, one or more of the emergency data 270 can include additional details and/or information associated with the user in addition to and/or in lieu of those noted above.

In one embodiment, as the emergency data 270 is being outputted, an input device 275 can detect the user 205 accessing the device 200. The input device 275 can be a component of the device 200 configured to detect the user 205 accessing the device 200 and/or entering one or more inputs. The input device 275 can include one or more buttons, a touch device, an image capture device, and/or any additional device configured to detect an access or input from the user 205.

In one embodiment, if the input device 275 detects the user 205 accessing the input device 275, the controller and/or the response application can determine that the user 205 may not need emergency assistance. In response, the controller and/or the response application can proceed to configure the audio component 240 to stop outputting one or more audible alerts. Additionally, the controller and/or the response application can stop rendering one or more of the emergency data 270 on the display device 260.

FIG. 3 illustrates a block diagram of a response application 310 responding to a detected emergency event according to an embodiment. As noted above, in response to a sensor 330 detecting information around the device, the response application 310 and/or the controller 320 can identify the emergency event using the detected information. As illustrated in FIG. 3, the sensor 330 has detected information from or around the device and/or a user of the device.

In response, the controller 320 and/or the response application 310 attempt to identify the emergency event. As noted above, when identifying the emergency event, the controller 320 and/or the response application 310 can compare the detected information to one or more predefined conditions to identify whether the emergency event is or includes an accident with an impact, a fire, the user being lost, the user making an emergency alert, and/or any additional accident. In other embodiments, additional predefined conditions can be considered by the response application 310 and/or the controller 320 to identify an emergency event in addition to and/or in lieu of those noted above.

As illustrated in FIG. 3, one or more of the predefined conditions can be stored in a database 395. The database 395 can be stored on the device or on another location accessible to the response application 310, the controller 320, and/or the device. In one embodiment, the database 395 can include one or more entries corresponding to one or more emergency events. As illustrated in FIG. 3, each of the entries of the database 395 can include an emergency event, predefined conditions associated with the emergency event, and/or emergency data associated with the emergency event. In other embodiments, the entries can include additional details and/or information in addition to and/or in lieu of those noted above and illustrated in FIG. 3.

In one embodiment, using the detected information, the response application 310 and/or the controller 320 can scan one or more entries of the database 395 for a match. As illustrated in the present embodiment, if the detected information includes the sensor 330 detecting a sudden stop or recoil while the device is moving above a predefined speed, the response application 310 and/or the controller 320 can identify the emergency event as including an accident involving an impact. The predefined speed can be defined by the user, the controller, 320, and/or the response application 310. In one embodiment, the user can be in an impact if the user is in a car accident, if the user hits an object, if an object hits the user, and/or if the user falls.

If the detected information includes one or more shouts, screams, cries, and/or calls for help from the user, the response application 310 and/or the controller 320 can identify that the emergency event is or includes an emergency alert. As noted above, one or more of the emergency alerts can be made by the user if the user needs help. In one embodiment, when detecting an emergency alert, the sensor 330, the controller 320, and/or response application 310 can use voice recognition technology to insure that the emergency alert is made by the user. In another embodiment, the sensor 330, the controller 320, and/or the response application 310 can detect key words, such as "help", "accident", or "need assistance" when identifying the emergency alert.

In another embodiment, if the detected information includes an ambient temperature around the device exceeding a threshold temperature, the response application 310 and/or the controller 320 can identify the emergency event as or including the user being in or around a fire. The threshold temperature can correspond to a temperature of a fire and can be predefined by the user, the controller, the response application, and/or the device.

In another embodiment, if the detected information includes a location of the device being outside one or more predefined locations, the response application 310 and/or the controller 320 can identify the emergency event as or including the user being lost. One or more predefined locations can be defined by the user, the device, the response application 310, the controller 320, and/or by any additional service.

In other embodiments, if the detected information includes the sensor 330, the response application 310 and/or the controller 320 not receiving a response from a polling request of the components of the device, the controller 320 and/or the response application 310 can determine that the device and/or one or more components of the device have become damaged from a scenario different from any of the listed conditions. As a result, the emergency event can be generically identified as an accident in which the user may need emergency assistance.

In response to an emergency event being identified, the response application 310 and/or the controller can determine that en emergency event is detected and proceed to instruct an audio component 340 to output one or more audible alerts. Further, the response application 310 and/or the controller 320 can select emergency data to render on the display device 360 based on the identified emergency event. In one embodiment, the response application 310 and/or the controller 320 additionally instruct the audio component to output the emergency data as one or more audio signals.

As noted above, one or more of the emergency data can be listed in the database 395 and can correspond to an identified emergency event. One or more of the emergency data can be associated with the user and can include details which can be different from one another. As illustrated in FIG. 3, if the emergency event includes an accident including an impact, the corresponding emergency data can list for a profile of the user to be displayed, one or more messages to call an emergency service provider, a spouse, and a doctor.

In another embodiment, if the emergency event includes an emergency alert from the user, the corresponding emergency data can list for the profile for the user to be displayed, one or more most recent contacts to be displayed, and a message to contact an emergency service and the spouse. In other embodiments, the emergency data can include additional details or information corresponding to the user and/or an emergency event in addition to and/or in lieu of those noted above and illustrated in FIG. 3.

Figure 4A:
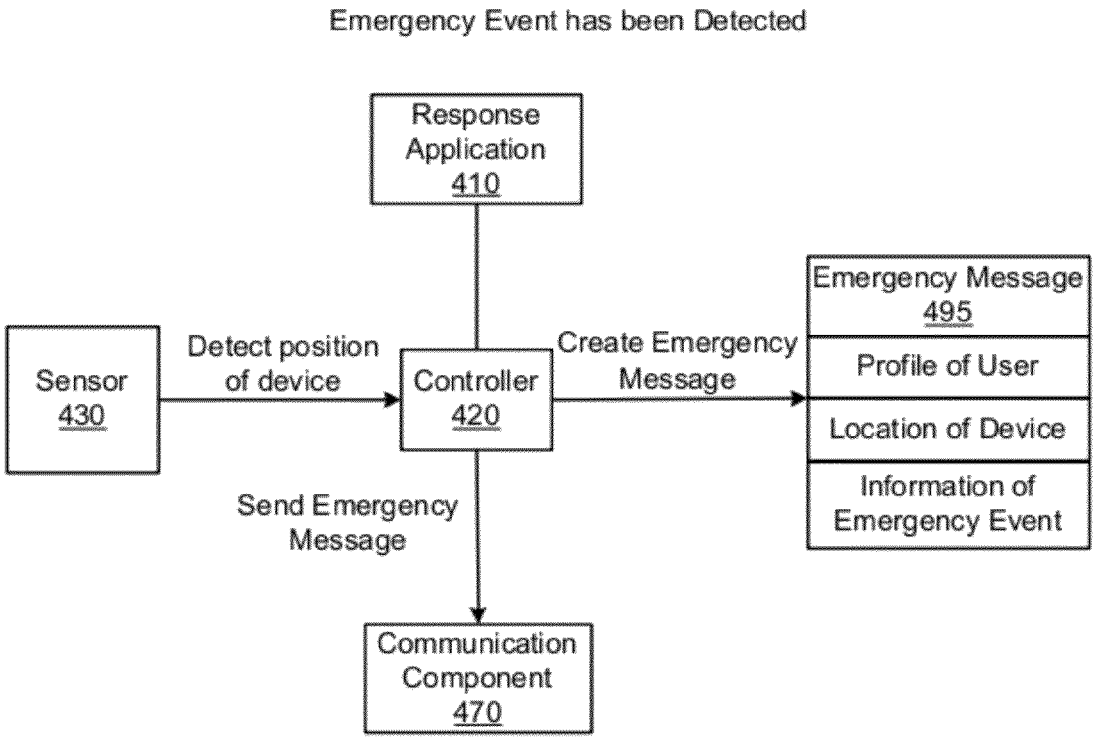
FIG. 4A and FIG. 4B illustrate a block diagram of a response application responding to a detected emergency event according to an embodiment.
Figure 4B:
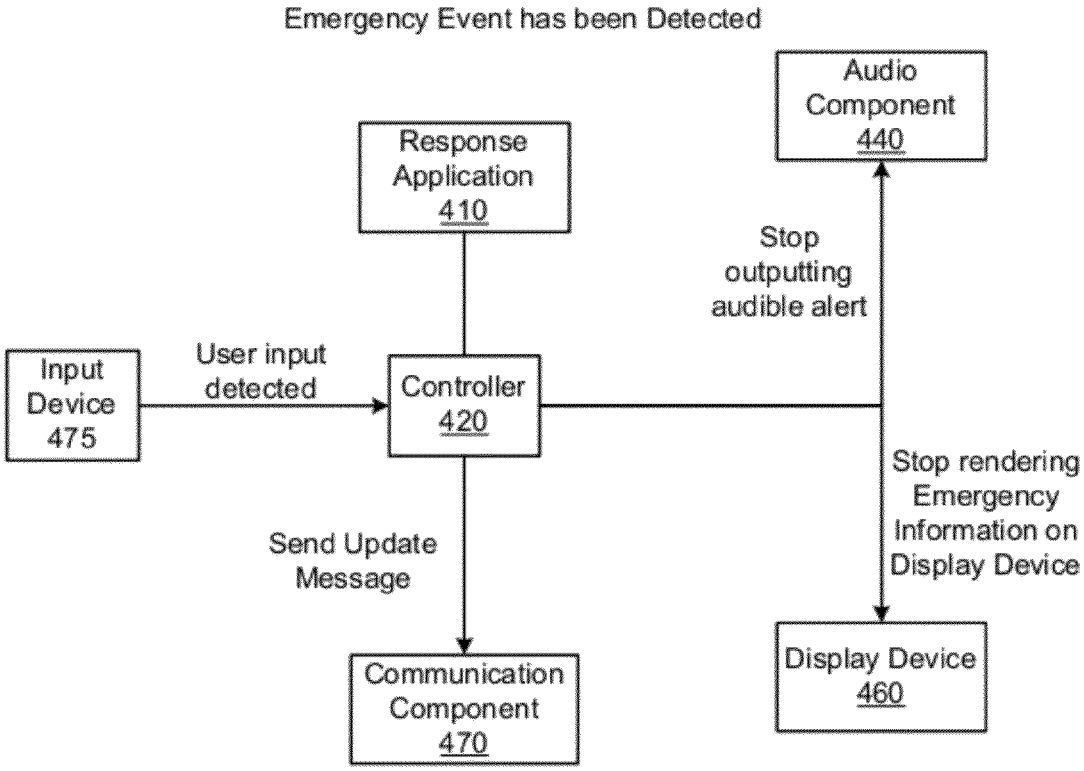

FIG. 4A and FIG. 4B illustrate a block diagram of a response application responding to a detected emergency event according to an embodiment. As noted above, in response to detecting and/or identifying an emergency event, the response application 410 and/or the controller 420 can select emergency data from the device to render on a display device.

In one embodiment, as illustrated in FIG. 4A, the response application 410 and/or the controller 420 can additionally generate an emergency message 495. An emergency message 495 is a message which can be generated by the response application 410 and/or the controller 420 and can be sent or transmitted by a communication component 470 of the device.

The communication component 470 is a hardware component of the device configured to allow the device to send or transmit one or more emergency messages. In one embodiment, the communication component can be or include a radio component, a Bluetooth component, an infrared component, a wireless network component, and/or any additional component configured to send or transmit one or more messages.

The emergency message 495 can be automatically sent by the response application 410 and/or the controller in response to the emergency event being detected. In another embodiment, the response application 410 and/or the controller 420 can send the emergency message 495 after a predefined amount of time has elapsed from a time when the emergency event was detected. When sending the emergency message 495, the communication component 470 can send the emergency message 495 as a file, a text message, an SMS (short message service) message, an MMS (multimedia messaging service) message, an email, a voice message, a video message, and/or any other form of message.

Additionally, the emergency message 495 can be sent to a predefined contact on the device, a most recent contact on the device, an emergency service provider, and/or a service provider. Further, as illustrated in FIG. 4A, the emergency message 495 can include a profile of the user, a location of the device previously detected by the sensor 430, the identified emergency event, and/or any additional information associated with the user or the emergency event. In other embodiments, the emergency message 495 can include additional information and/or details in addition to and/or in lieu of those noted above and illustrated in FIG. 4A.

In response to displaying the emergency data and/or sending an emergency message 495, an input device 475 of the device can detect the user accessing the device or entering one or more inputs. In response to detecting an input or access, the input device can notify the response application 410 and/or the controller 420 that the user has accessed the device. In response, the response application 410 and/or the controller 420 can determine that the user does not need emergency assistance.

As illustrated in FIG. 4B, the response application 410 and/or the controller 420 can proceed to send an instruction for the audio component 440 to stop outputting the audible alert. Additionally, the response application 410 and/or the controller 420 proceed to send an instruction for the display device 460 to stop rendering the emergency data. In one embodiment, the response application 410 and/or the controller 420 further generate an updated message listing that the user does not need emergency assistance. The updated message can be sent by the communication component 470 to any contact and/or service provider which the emergency message 495 was previously sent to.

Figure 5:
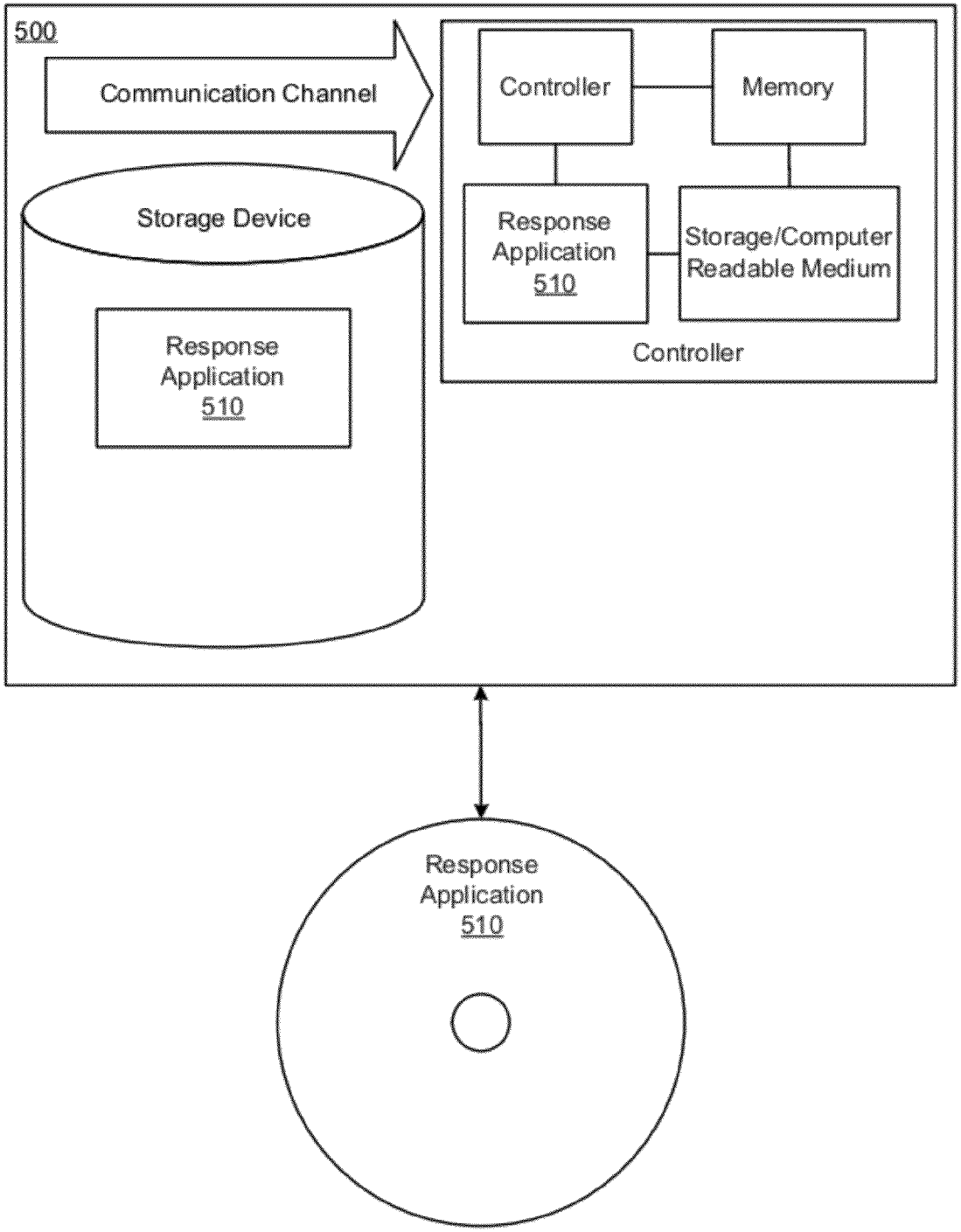
FIG. 5 illustrates a response application on a device and a response application stored on a removable medium being accessed by the device according to an embodiment.

FIG. 5 illustrates a device 500 with a response application 510 and a response application 510 stored on a removable medium being accessed by the device 500 according to an embodiment of the invention. For the purposes of this description, a removable medium is any tangible apparatus that contains, stores, communicates, or transports the application for use by or in connection with the device 500. As noted above, in one embodiment, the response application 510 is firmware that is embedded into one or more components of the device 500 as ROM. In other embodiments, the response application 510 is an application which is stored and accessed from a hard drive, a compact disc, a flash disk, a network drive or any other form of computer readable medium that is coupled to the device 500.

Figure 6:
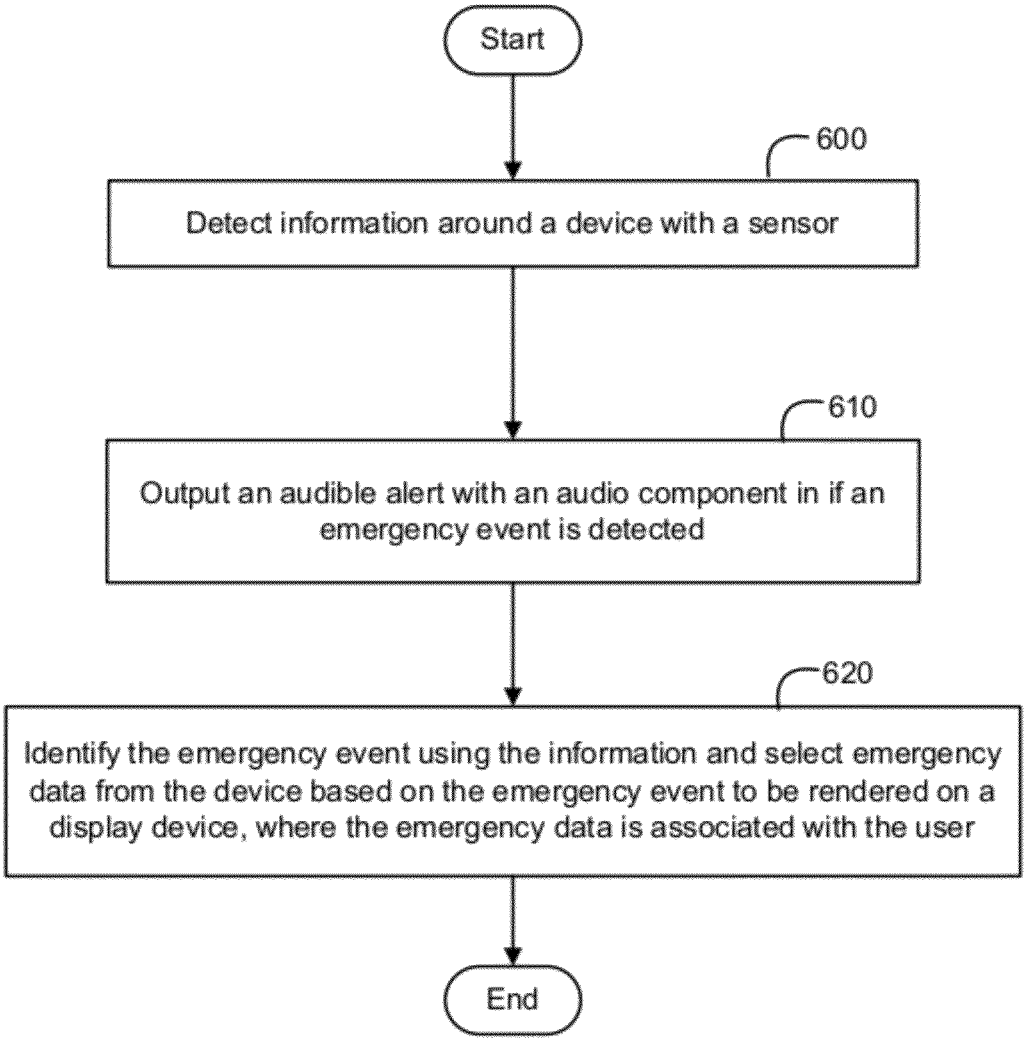
FIG. 6 is a flow chart illustrating a method for responding to an emergency event according to an embodiment.

FIG. 6 is a flow chart illustrating a method for responding to an emergency event according to an embodiment. The method of FIG. 6 uses a device with a controller, a sensor, an audio component, a display device, a communication channel, and/or a response application. In other embodiments, the method of FIG. 6 uses additional components and/or devices in addition to and/or in lieu of those noted above and illustrated in FIGS. 1, 2, 3, 4, and 5.

As noted above, the response application is an application which can be used in conjunction with the controller to detect an emergency event of a user of the device and respond to the emergency event. The emergency event includes an event or circumstance in which the user may need emergency assistance from. In one embodiment, the emergency event can be or include the user being in an accident involving an impact, a fire, the user making an emergency alert, the user being lost, and/or any additional accident in which the user may need emergency assistance from. The user can be any person who can access and use the device.

A sensor can initially be used by the controller and/or the response application to detect information around the device 600. As noted above, detecting the emergency event includes the response application and/or the controller using any detected information from the sensor to identify the emergency event. The sensor can be a hardware component configured to detect data and/or information from or around the device. In one embodiment, the sensor can include an accelerometer, a microphone, a thermal sensor, a gyroscope, and/or any additional component configured to detect data and/or information which can be used to identify an emergency event.

In one embodiment, the controller and/or the response application can instruct the sensor to actively detect the data and/or information around the device or the user. The information detected by the sensor can include whether the device is moving, a speed the device is moving, an abrupt stop or recoil of the device, a temperature around the device, a location of the device, and/or an emergency alert from the user. In another embodiment, the information can be whether one or more components of the device are responding to a polling request.

In response to the sensor detecting any information, the sensor can notify the controller and/or the media application. The controller and/or the media application can then attempt to identify the emergency event. As noted above, if the response application and/or the controller identify the emergency event, the response application and/or the controller can determine that an emergency event has been detected.

If an emergency event has been detected, the controller and/or the response application can instruct the audio component to output an audible alert 610. As noted above, the audio component can include one or more audio speaker and/or any additional component configured to output one or more audible alerts. Additionally, the audible alert can include one or more tones, signals, and/or voices which can alert one or more people around the device of the emergency event. In one embodiment, the audible alert can continue to increase in strength, intensity, frequency, and/or tone.

As noted above, when identifying the emergency event, the controller and/or the media application can compare the detected information to one or more predefined conditions to identify whether the emergency event is or includes the user being in an accident involving an impact, a fire, the user making an emergency alert, the user being lost, and/or any additional accident which the user may need emergency assistance from.

Further, the controller and/or the response application can select emergency data from the device based on the emergency event and proceed to render the emergency data on a display device 620. The display device is an output device coupled to the device and configured to display emergency data from the device. When rendering the emergency data on the display device, the display device can brighten and display the emergency data. In another embodiment, the display device can be configured to display one or more visual alerts which can be flashed or blinked on the display device.

As noted above, the selected emergency data is associated with the user of the device. In one embodiment, the emergency data can include a message indicating that the user has been in an emergency event and needs assistance. In another embodiment, the emergency data can include a profile of the user. The profile can list a name, an address of the user, and/or any medical condition of the user. In other embodiments, the emergency data can list one or more contacts of the user. A contact can be predefined by the user. In another embodiment, a contact can be a emergency service provider, a service provider, and/or a physician of the user. In other embodiments, a contact can include the most recent contacts of the user. The method is then complete. In other embodiments, the method of FIG. 6 includes additional steps in addition to and/or in lieu of those depicted in FIG. 6.

Figure 7:
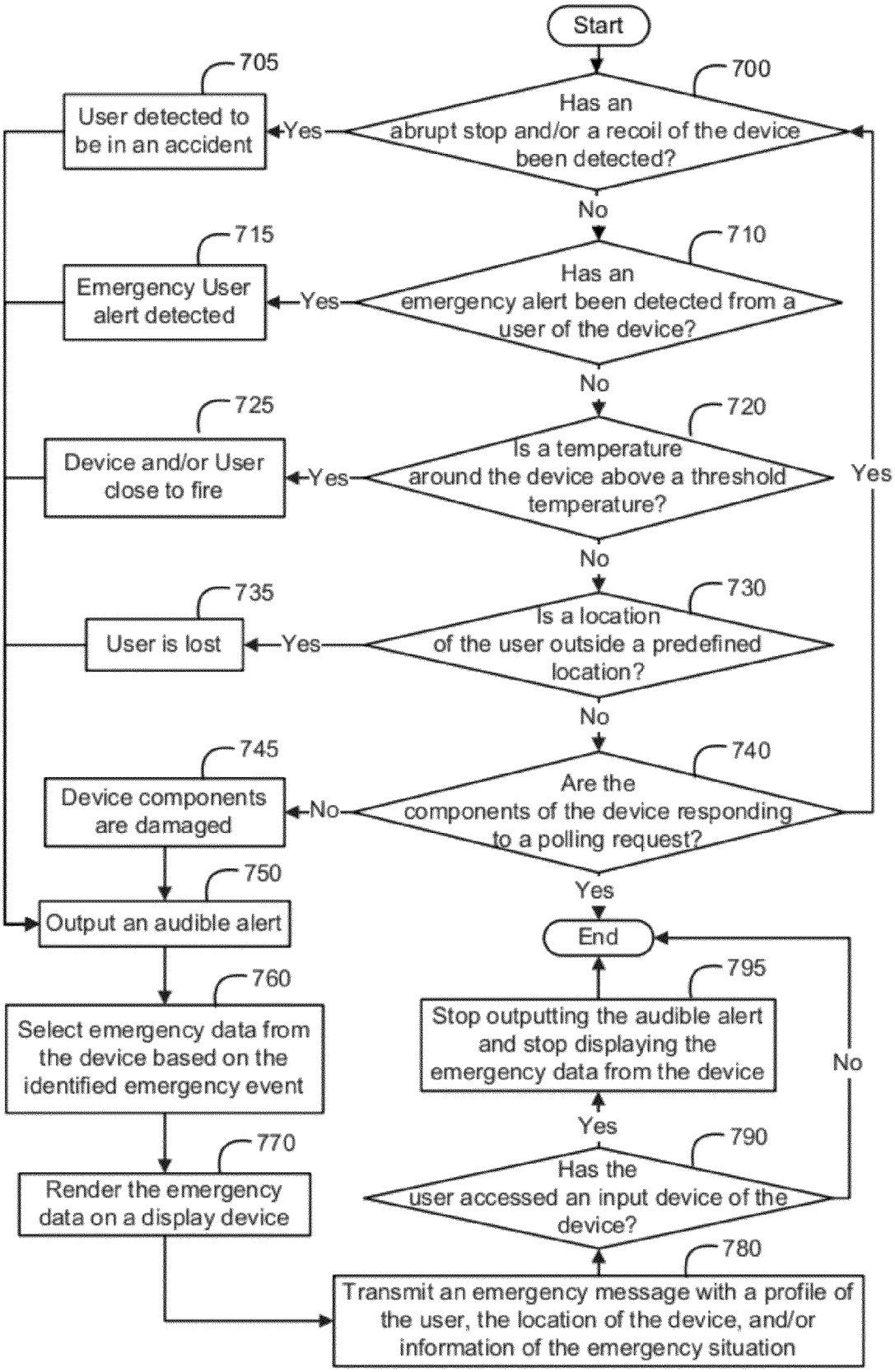
FIG. 7 is a flow chart illustrating a method for responding to an emergency event according to another embodiment.

FIG. 7 is a flow chart illustrating a method for responding to an emergency event according to another embodiment. Similar to above, the method of FIG. 7 uses a device with a controller, a sensor, an audio component, a display device, a communication channel, and/or a response application. In other embodiments, the method of FIG. 7 uses additional components and/or devices in addition to and/or in lieu of those noted above and illustrated in FIGS. 1, 2, 3, 4, and 5.

As noted above, a sensor of the device can initially detect information from or around the device. In response to detecting any information, the controller and/or the response application can compare the detected information to one or more predefined conditions to identify the emergency event. In one embodiment, the emergency event can include the user being in an accident involving an impact, the user making an emergency alert, the user being in or around a fire, the user being lost, and/or any additional accident which the user may need emergency assistance from.

The sensor can include an accelerometer, a thermal sensor, a GPS, a microphone, and/or any additional component configured to detect information and/or data. When detecting information, the sensor can detect whether an abrupt stop or and/or a recoil of the device has been detected if the device is in motion 700. If the sensor detects an abrupt stop and/or recoil of the device, the controller and/or the response application can identify the emergency event to be or include the user being in an accident involving an impact 705. In response to identifying the emergency event, an emergency event will be determined to be detected and an audio component of the device can proceed to output one or more audible alerts 750.

In another embodiment, if no abrupt stop or recoil of the device is detected, the sensor can proceed to detect whether an emergency alert has been made by the user of the device 710. As noted above, the emergency alert can be detected in response to the user yelling, shouting, crying, and/or calling for help. In one embodiment, the sensor, the response application, and/or the controller can use voice recognition technology when detecting an emergency alert from the user. In other embodiments, the sensor, the response application, and/or the controller can further detect one or more keywords when detecting the emergency alert.

If the sensor detects any of the above emergency alerts from the user, the response application and/or the controller will determine that an audible user alert has been detected and identify that the emergency event is or includes the user making an emergency alert 715. In response to detecting an emergency event, an audio component of the device can then proceed to output one or more audible alerts 750.

In another embodiment, if no emergency alert is detected from the user, the sensor can detect a temperature around the device and the response application and/or the controller can determine whether the detected temperature exceeds a temperature threshold 720. As noted above, the threshold temperature corresponds to a temperature of a fire. If the detected temperature exceeds the temperature threshold, the response application and/or the controller will determine that the emergency event is or includes the device and/or the user being in or close to a fire 725. In response to detecting an emergency event, an audio component of the device can then proceed to output one or more audible alerts 750.

In another embodiment, if the detected temperature does not exceed the threshold temperature, the sensor can proceed to detect a location of the device and determine whether the detected location is outside a predefined location 730. The response application and/or the controller can compare the detected location to one or more predefined locations. If the detected location is outside one or more of the predefined locations, the response application and/or the controller can identify that the emergency event is or includes the device and/or the user being lost 735. In response to detecting an emergency event, an audio component of the device can then proceed to output one or more audible alerts 750.

In other embodiments, the sensor, the controller, and/or the response application can proceed to poll one or more of the components for a response to determine whether they are functioning 740. If the components do respond and no additional emergency events were detected, the response application and/or the controller can determine that no emergency event is present and the method can be complete. In another embodiment, the response application, the controller, and/or the sensor can continue to detect information from or around the device to detect and/or identify an emergency event.

In other embodiments, if the components do not respond, the response application and/or the controller can determine that the device and/or one or more components of the device are not functioning correctly and the device is damaged 745. As a result, the response application and/or the controller can identify that the emergency event is or includes an accident which does not match any of the predefined conditions. As noted above, in response to an emergency event being detected and/or identified, an audio component of the device can proceed to output one or more audible alerts 750.

Additionally, as noted above, in response to an emergency event being detected and/or identified, the response application and/or the controller can proceed to select one or more emergency data from the device based on the identified emergency event 760. As noted above, one or more of the emergency data can be included in one or more entries of a database of the device. Further, one or more of the emergency data can be associated with the user and can correspond to the emergency event.

Once an emergency data has been selected, the response application and/or the controller can render the selected emergency data on a display device 770. As noted above, the emergency data can include one or more messages, one or more of the identified emergency events, a profile of the user, and/or one or more contacts of the user.

In one embodiment, the response application and/or the controller can additionally generate an emergency message with a profile of the user, a location of the user, and/or listing the emergency event. The emergency event can then be sent and/or transmitted to one or more contacts or service providers with a communication component of the device 780. Additionally, the device can include an input device configured to detect the user accessing and/or entering one or more inputs on the device 790. If no access or input is detected, the method is complete. In another embodiment, if the input device detects an access or input, the response application will determine that the user does not need emergency assistance.

The response application will then configure the audio component to stop outputting the audible alert and configure the display device to stop displaying the emergency data 795. In one embodiment, the response application and/or the controller can additionally generate an update message indicating that the user does not need emergency assistance and send the update message to any contact or service provider which previously received the emergency message. The method is then complete. In other embodiments, the method of FIG. 7 includes additional steps in addition to and/or in lieu of those depicted in FIG. 7.

What is claimed is:

1. A device comprising:

one or more sensors to detect information around the device;

an audio component to output sound;

a communication component;

an input device to enable a user access the device;

a display device; and a controller to (i) use the information to identify an emergency event of the user, (ii) in response to identifying the emergency event, cause an audible alert to be output by the audio component, (iii) select emergency data stored on the device to be rendered on the display device based on the emergency event, wherein the emergency data is associated with the user, (iv) automatically generate an emergency message, and (v) after a predefined amount of time has elapsed from a time when the emergency event was identified, wirelessly transmit the emergency message to another device via the communication component;

wherein the controller causes the display device to stop rendering the emergency data in response to detecting the user accessing the input device.

2. The device of claim 1, wherein the one or more sensors includes an accelerometer to detect at least one of a speed of the device, a sudden stop of the device, or a recoil of the device.

3. The device of claim 1, wherein the one or more sensors includes a microphone to detect an emergency alert provided by the user.

4. The device of claim 1, wherein the one or more sensors includes a thermal sensor to detect a temperature of the device exceeding a threshold temperature.

5. The device of claim 1, wherein the one or more sensors includes a global positioning system to detect a location of the device.

6. The device of claim 1, wherein the audio component continues to increase a volume of the audible alert.

7. The device of claim 1, wherein the audio component outputs the emergency data.

8. The device of claim 1, wherein the emergency message is transmitted to at least one of a predefined contact on the device, a most recent contact, or a service provider.

9. The device of claim 8, wherein the emergency message includes information of the user, a location of the device, and information of the emergency event.

10. A method for responding to an emergency event, the method being performed by a controller of a user's and comprising:

detecting information around the user's device with one or more sensors;

identifying an emergency event by comparing the information to a plurality of predefined conditions corresponding to a plurality of emergency events stored in a database;

selecting emergency data stored on the user's device based on the emergency event to be rendered on a display device, wherein the emergency data is associated with the user;

rendering the emergency data selected on the display device;

automatically generating an emergency message; and after a predefined amount of time has elapsed from a time when the emergency event was identified, wirelessly transmitting the emergency message to another device via a communication component of the user's device;

wherein the user's device includes an input device to enable the user to access the user's device; and wherein the controller causes the display device to stop rendering the emergency data in response to detecting the user accessing the input device.

11. The method of claim 10, wherein the plurality of emergency events includes an accident involving an impact of the user, the user being in danger, the user being around a fire, and the user being lost.

12. The method of claim 10, wherein identifying the emergency event includes the one or more sensors detecting at least one of an abrupt stopping and a recoil of the user's device when the user's device is in motion to determine that the user has been in an accident involving an impact.

13. The method of claim 10, wherein identifying the emergency event includes utilizing voice recognition to detect an emergency alert provided by the user.

14. The method of claim 10, wherein identifying the emergency event includes detecting a temperature around the user's device to determine that the temperature around the user exceeds a threshold temperature.

15. The method of claim 10, wherein identifying the emergency event includes detecting a location of the user and determining that the user is lost.

16. The method of claim 10, wherein identifying the emergency event includes polling components of the user's device for a response to determine that the components are damaged.

17. A non-transitory computer readable medium storing instructions that, when executed by a controller of a user's device, causes the controller to perform operations comprising:

detecting information around the user's device with one or more sensors;

identifying an emergency event of a user by comparing the information to a plurality of predefined conditions corresponding to a plurality of emergency events stored in a database;

selecting emergency data stored on the user's device based on the emergency event to be rendered on a display device, wherein the emergency data is associated with the user;

rendering the emergency data selected on the display device;

automatically generating an emergency message that includes information of the user, a location of the user's device, and information of the emergency event; and after a predefined amount of time has elapsed from a time when the emergency event was identified, wirelessly transmitting the emergency message to another device via a communication component of the user's device;

wherein the user's device includes an input device to enable the user to access the user's device; and wherein the controller causes the display device to stop rendering the emergency data in response to detecting the user accessing the input device.

18. The non-transitory computer readable medium comprising instructions of claim 17, wherein the emergency data includes at least one from the group consisting of a name of the user, an address of the user, a medical condition of the user, a physician of the user, a contact of the user, and a service provider of the user.

* * * * *